US009455075B1

(12) United States Patent
Chen et al.

(10) Patent No.: US 9,455,075 B1
(45) Date of Patent: Sep. 27, 2016

(54) OVER-CURRENT PROTECTION DEVICE

(71) Applicant: Fuzetec Technology Co., Ltd., New Taipei (TW)

(72) Inventors: Jack Jih-Sang Chen, New Taipei (TW); Chang-Hung Jiang, New Taipei (TW)

(73) Assignee: Fuzetec Technology Co., Ltd., New Taipei (TW)

( * ) Notice: Subject to any disclaimer, the term of this patent is extended or adjusted under 35 U.S.C. 154(b) by 0 days.

(21) Appl. No.: 14/831,377

(22) Filed: Aug. 20, 2015

(51) Int. Cl.
*H01C 7/10* (2006.01)
*H01C 7/02* (2006.01)

(52) U.S. Cl.
CPC ..... *H01C 7/027* (2013.01); *H01C 7/021* (2013.01)

(58) Field of Classification Search
CPC ..... H01C 7/027; H01C 7/021
USPC ..... 338/22 R, 13
See application file for complete search history.

(56) References Cited

U.S. PATENT DOCUMENTS 4,689,475 A * 8/1987 Kleiner ..... B01D 35/06 219/553
5,955,936 A * 9/1999 Shaw, Jr. ..... H01C 1/1406 338/22 R
6,143,206 A * 11/2000 Handa ..... H01C 7/027 219/541
6,223,423 B1 * 5/2001 Hogge ..... H01C 1/1406 29/610.1
6,359,544 B1 * 3/2002 Blok ..... H01C 7/027 252/511
7,001,538 B2 * 2/2006 Lee ..... H01B 1/24 252/511
7,382,224 B2 * 6/2008 Wang ..... H01C 7/027 219/548

* cited by examiner

*Primary Examiner* — Kyung Lee
(74) *Attorney, Agent, or Firm* — Brinks Gilson & Lione; John C. Bacoch

(57) ABSTRACT

An over-current protection device includes first and second electrodes and a multilayered structure including first and second PTC polymer material layers that are stacked one above the other and that are bonded to each other. The first PTC polymer material layer includes a first polymer matrix and a particulate conductive filler. The second PTC polymer material layer includes a second polymer matrix and a particulate conductive filler. The second polymer matrix is made from a second polymer composition that contains. One of the first and second polymer compositions contains polyvinylidene fluoride and polyolefin and the other of the first and second polymer compositions contains polyolefin or polyvinylidene fluoride.

12 Claims, 4 Drawing Sheets

OVER-CURRENT PROTECTION DEVICE

FIELD

The disclosure relates to an over-current protection device, more particularly to an over-current protection device including two PTC polymer material layers, one of which includes a polymer matrix made from a polymer composition that contains polyvinylidene fluoride and polyolefin.

BACKGROUND

A positive temperature coefficient (PTC) material exhibits a positive temperature coefficient effect that renders the same to be useful as a protecting device, such as a fuse.

Referring to FIG. 1, a conventional over-current protection device includes a PTC polymer material layer 81 and first and second electrodes 82, 83 formed on two opposite surfaces of the PTC polymer material layer 81. The PTC polymer material layer 81 includes a polymer matrix of a polymer material that contains a crystalline region (not shown) and a non-crystalline region (not shown), and a conductive particulate filler (not shown) that is dispersed in the non-crystalline region of the polymer matrix and that is formed into a continuous conductive path for electrical conduction between the first and second electrodes 82, 83. The PTC effect is a phenomenon that when the temperature of the polymer matrix is raised to its melting point, crystals in the crystalline region start melting, which results in generation of a new non-crystalline region. As the new non-crystalline region is increased to an extent to merge into the original non-crystalline region, the conductive path of the conductive particulate filler will become discontinuous and the resistance of the PTC polymer material will be sharply increased, thereby resulting in an electrical disconnection between the first and second electrodes 82, 83.

The operating temperature of the over-current protection device may be adjusted by adjusting the composition of the polymer matrix. However, the operating temperature can only reach a value within a range of from bout −40° C. to about 85° C. when the polymer matrix is made from polyolefin.

In order to achieve a higher and broader range of operating temperature, such as between −40° C. to 125° C., the polymer matrix may be made from polyvinylidene fluoride (PVDF).

U.S. Pat. No. 5,451,919 discloses a conductive polymer composition having a resistivity at 20° C. of less than 10 ohm-cm. The conductive polymer composition contains at least 50 vol % of polyvinylidene fluoride and 1 to 20 vol % of a second crystalline fluorinated polymer. The conductive polymer composition was compression-molded to form a plaque. The plaque was laminated on two sides with electrodeposited nickel foil to form a laminate. The laminate is irradiated to a dosage of 10 Mrads using an electron beam. The polyvinylidene fluoride is under a trade name of Kynar. However, the operating voltage or the breakdown voltage of the over-current protection device including the aforesaid conductive polymers can only reach 30 Vdc according to thermal runaway test.

In view of the foregoing, there is a need to improve the operating temperature as well as the operating voltage of an over-current protection device.

SUMMARY

An object of the disclosure is to provide an over-current protection device that has a high operating temperature and a high operating voltage.

According to one aspect of the disclosure, an over-current protection device includes first and second electrodes and a multilayered structure disposed between the first and second electrodes and including first and second PTC polymer material layers that are stacked one above the other and that are bonded to each other. The first PTC polymer material layer includes a first polymer matrix and a particulate conductive filler dispersed in the first polymer matrix. The first polymer matrix is made from a first polymer composition. The second PTC polymer material layer includes a second polymer matrix and a particulate conductive filler dispersed in the second polymer matrix. The second polymer matrix is made from a second polymer composition. One of the first and second polymer compositions contains polyvinylidene fluoride and polyolefin, and the other of the first and second polymer compositions contains polyolefin or polyvinylidene fluoride. The other of the first and second polymer compositions is substantially free of polyvinylidene fluoride when containing polyolefin, and is substantially free of polyolefin when containing polyvinylidene fluoride.

According to another aspect of the disclosure, an over-current protection device includes first and second electrodes and a multilayered structure disposed between the first and second electrodes and including first and second PTC polymer material layers that are stacked one above the other and that are bonded to each other. The first PTC polymer material layer includes a first polymer matrix and a particulate conductive filler dispersed in the first polymer matrix. The first polymer matrix is made from a first polymer composition that contains polyvinylidene fluoride and polyolefin, and the weight ratio of the polyvinylidene fluoride to the polyolefin ranges from 1:9 to 9:1. The second PTC polymer material layer includes a second polymer matrix and a particulate conductive filler dispersed in the second polymer matrix. The second polymer matrix is made from a second polymer composition that contains at least one of polyolefin and polyvinylidene fluoride. When the second polymer composition contains polyolefin and polyvinylidene fluoride, the weight ratio of the polyvinylidene fluoride to the polyolefin of the second polymer composition is out of the range of from 1:9 to 9:1. The over-current protection device exhibits a trip surface temperature ranging from 110 to 150° C. and a breakdown voltage ranging from 30 to 100 V.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
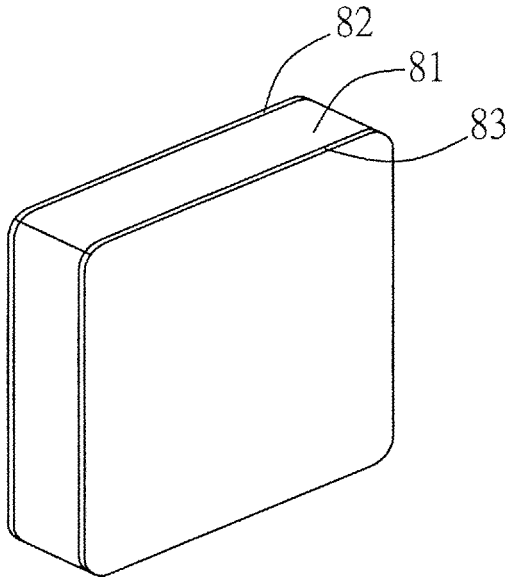
F I G. 1 PRIOR ART
FIG. 1 is a perspective view of a conventional PTC over-current protection device.

Before the disclosure is described in greater detail, it should be noted that like elements are denoted by the same reference numerals throughout the disclosure.

Figure 2:
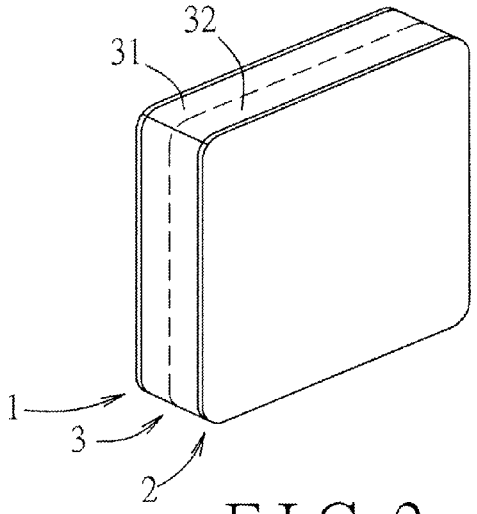
FIG. 2 is a perspective view of the first embodiment of a PTC over-current protection device according to the disclosure.

Referring to FIG. 2, the first embodiment of an over-current protection device of the disclosure includes first and second electrodes 1, 2, and a multilayered structure 3 disposed between the first and second electrodes 1, 2 and including first and second PTC polymer material layers 31, 32 that are stacked one above the other and that are bonded to each other.

The first PTC polymer material layer 31 includes a first polymer matrix and a particulate conductive filler dispersed in the first polymer matrix. The first polymer matrix is made from a first polymer composition.

The second PTC polymer material layer 32 includes a second polymer matrix and a particulate conductive filler dispersed in the second polymer matrix. In this embodiment, the second polymer matrix is made from a second polymer composition.

In certain embodiments, one of the first and second polymer compositions contains polyvinylidene fluoride and polyolefin, and the other of the first and second polymer compositions contains polyolefin or polyvinylidene fluoride. The other the first and second polymer compositions is substantially free of polyvinylidene fluoride when containing polyolefin, and is substantially free of polyolefin when containing polyvinylidene fluoride.

Preferably, each of the first and second polymer compositions further contains a grafted polyolefin.

Preferably, the weight ratio of the polyvinylidene fluoride to the polyolefin of the one of the first and second polymer compositions ranges from 1:9 to 9:1.

Preferably, polyvinylidene fluoride has a melt flow rate ranging from 0.5 g/10 min to 30 g/10 min measured according to ASTM D-1238 under a temperature of 230° C. and a load of 12.5 Kg.

Preferably, polyvinylidene fluoride has a melting point ranging from 140 to 180° C.

Preferably, the particulate conductive fillers of the first and second polymer compositions are carbon black.

Preferably, polyolefin is polyethylene.

Preferably, the first PTC polymer material layer contains 4.7-42.3 wt % of polyvinylidene fluoride, 4.7-42.3 wt % of polyolefin based on 100 wt % of the first PTC polymer material layer.

Preferably, the second PTC polymer material layer contains 23.5-45.0 wt % of the polyolefin based on 100 wt % of the second PTC polymer material layer.

Figure 3:
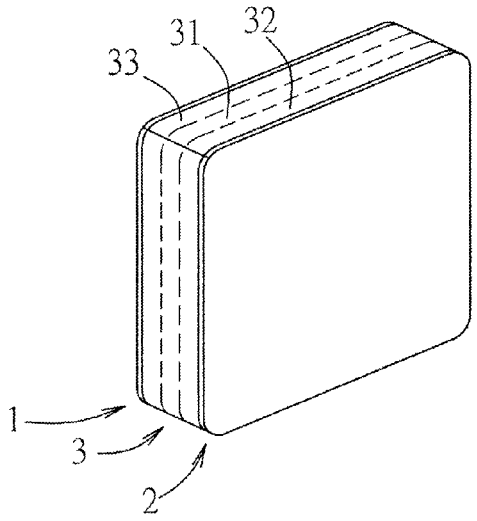
FIG. 3 is a perspective view of the second embodiment of a PTC over-current protection device according to the disclosure.

Referring to FIG. 3, the second embodiment of an over-current protection device of the disclosure includes first and second electrodes 1, 2, and a multilayered structure 3 disposed between first and second electrodes 1, 2 and including first, second and third PTC polymer material layers 31, 32, 33 that are stacked one above another and that are bonded to one another. The first and second PTC polymer material layers 31, 32 are the same as those in the first embodiment. In this embodiment, the third PTC polymer material layer 33 is stacked on the first PTC polymer material layer 31 oppositely of the second PTC polymer material layers 32, and includes a third polymer matrix and a particulate conductive filler dispersed in the third polymer matrix. The third polymer matrix is made from a third polymer composition.

In certain embodiments, the first polymer composition contains polyvinylidene fluoride and polyolefin, and the third polymer composition contains polyolefin or polyvinylidene fluoride.

In certain embodiments, the first polymer composition contains polyvinylidene fluoride or polyolefin, and the third polymer composition contains polyolefin and polyvinylidene fluoride.

The third embodiment of an over-current protection device of the disclosure has the structure similar to that of the first embodiment, except that, in this embodiment, each of the first and second polymer compositions contains polyolefin and polyvinylidene fluoride. The weight ratio of the polyvinylidene fluoride to the polyolefin in the first polymer composition ranges from 1:9 to 9:1, and the weight ratio of the polyvinylidene fluoride to the polyolefin in the second polymer composition is out of the range of from 1:9 to 9:1.

The over-current protection device of each of the embodiments exhibits a trip surface temperature ranging from 110 to 150° C. and a breakdown voltage ranging from 30 to 100 V.

The following examples and comparative examples are provided to illustrate the embodiments of the disclosure, and should not be construed as limiting the scope of the disclosure.

EXAMPLES

Eight formulas (polymer compositions) were used to prepare the PTC polymer material layers of the following Examples and Comparative Examples (see Table 1).

Materials used in the eight formulas include: HDPE (purchased from Formosa plastic Corp., catalog no.: HDPE9002, having a weight average molecular weight of 150,000 g/mole and a melt flow rate of 45 g/10 min according to AST D-1238 under a temperature of 230° C. and a load of 12.5 Kg) serving as polyolefin, grafted HDPE (purchased from DuPont, catalog no.: MB100D, having a weight average molecular weight of 80,000 g/mole and a melt flow rate of 75 g/10 min according to AST D-1238 under a temperature of 230° C. and a load of 12.5 Kg) serving as grated polyolefin, carbon black powder (purchased from Columbian Chemicals Company, catalog no.: Raven 430UB, having a DBP/D of 0.95 and a bulk density of 0.53 g/cm$^3$) serving as the particulate conductive filler, and PVDF (purchased from Arkema, catalog no.: Kynar 761, having a melting point of 170° C. and a melt flow rate of 3.0 g/10 min under a temperature of 230° C. and a load of 12.5 Kg).

TABLE 1

| Formulas | HDPE (wt%) | Grafted HDPE (wt%) | PVDF (wt%) | Carbon black (wt%) |
|---|---|---|---|---|
| Formula(1) | 2.35 | 2.35 | 42.30 | 53.00 |
| Formula(2) | 11.75 | 11.75 | 23.50 | 53.00 |
| Formula(3) | 21.15 | 21.15 | 4.70 | 53.00 |
| Formula(4) | 4.70 | 0.00 | 42.30 | 53.00 |
| Formula(5) | 23.50 | 0.00 | 23.50 | 53.00 |
| Formula(6) | 42.30 | 0.00 | 4.70 | 53.00 |
| Formula(7) | 22.50 | 22.50 | 0.00 | 55.00 |
| Formula(8) | 0.00 | 0.00 | 55.00 | 45.00 |

Example 1 (E1)

A first thin sheet of a PTC polymer material (serving as the first PTC polymer material layer) was prepared using Formula (1) that comprises 1.175 grams of HDPE (purchased from Formosa plastic Corp., catalog no.: HDPE9002, having a weight average molecular weight of 150,000 g/mole and a melt flow rate of 45 g/10 min according to AST D-1238 under a temperature of 230° C. and a load of 12.5 Kg), 1.175 grams of carboxylic acid anhydride grafted HDPE polyethylene (purchased from DuPont, catalog no.: MB100D, having a weight average molecular weight of 80,000 g/mole and a melt flow rate of 75 g/10 min according to AST D-1238 under a temperature of 230° C. and a load of 12.5 Kg), 21.15 grams of PVDF (purchased from Arkema, catalog no.: Kynar 761, having a melting point of 170° C. and a melt flow rate of 3.0 g/10 min under a temperature of 230° C. and a load of 12.5 Kg), and 26.5 grams of carbon black particles (trade name: Raven 430UB, average particle size: 82 nm, DBP oil-absorption: 75 cc/100 g, volatile content: 1.0 wt %, electrical conductivity: $2.86\times10^{4}$ $m^{-1}\Omega^{-1}$, commercially available from Columbian Chemicals Company). Formula (1) was compounded in a Brabender mixer. The compounding temperature was 200° C., the stirring rate was 30 rpm, and the compounding time was 10 minutes. The compounded mixture was hot pressed so as to forma first thin sheet of a PTC polymer material (serving as the first PTC polymer material layer) having a thickness of 0.175 mm. The hot pressing temperature was 200° C., the hot pressing time was 4 minutes, and the hot pressing pressure was 80 $kg/cm^2$.

A second thin sheet of a PTC polymer material (serving as the second PTC polymer material layer) was prepared using Formula (7) based on procedures and conditions similar to those of preparing the first thin sheet of the PTC polymer material.

Two copper foil sheets serving as the first and second electrode layers 1, 2 were respectively attached to two opposite sides of a stack of the first and second PTC polymer material layers, and were hot pressed under 200° C. and 80 $kg/cm^2$ for 4 minutes to form a sandwiched structure of a PTC laminate. The PTC laminate was cut into test samples with a size of 8 mm×8 mm. Each of the test samples was exposed to a total dose of 50 kGy of a cobalt-60 source.

The average resistance of the test samples of Example 1 at room temperature was determined and shown in Table 2.

Examples 2 to 6 (E2 to E6)

The procedures and conditions in preparing the test samples of Examples 2 to 6 (E2 to E6) were similar to those of Example 1 except that different combinations of the formulas were used for the first and second thin sheets of PTC polymer materials.

The formulas used to form the PTC laminates for E2 to E6 are shown in Table 2. The average resistances of the test samples of Examples 2 to 6 were determined and shown in Table 2.

Examples 7 and 10 (E7 and E10)

The procedures and conditions in preparing the test samples of Examples 7 and 10 (E7 and E10) were similar to those of Example 1 except that a third thin sheet of a PTC polymer material was further included in the PTC laminate for each one of Examples 7 and 10.

The compositions of the PTC laminates of Example 7-10 are shown in Table 2. The average resistances of the test samples of Examples 7 and 10 were determined and shown in Table 2.

Comparative Examples 1 to 4 (CE1 to CE4)

The procedures and conditions in preparing the test samples of Comparative Examples 1 to 4 (CE1 to CE4) were similar to those of Example 1 except that only one thin sheet of a PTC polymer material layer was employed for each Comparative Example.

The compositions of the PTC laminates are shown in Table 2. The average resistances of the test samples of Comparative Examples 1 to 4 were determined and shown in Table 2.

Comparative Example 5 (CE5)

The procedures and conditions in preparing the first and second thin sheets of Comparative Example 5 (CE5) were similar to those of Example 1 except that the first and second thin sheets of Comparative Example 5 were respectively made from Formula (7) and (8). Since the second thin sheet was made from formula (8) that contained PVDF and that was free of polyolefin, the same substantially had no adhesion. As a consequence, the first and second thin sheets were unable to be laminated for forming a PTC laminate.

Comparative Examples 6 and 7 (CE6 and CE7)

The procedures and conditions in preparing the test samples of Comparative Examples 6 and 7 (CE6 to CE7) were similar to those of Example 1 except that different combinations of the formulas were used for the first and second thin sheets of PTC polymer materials.

The formulas used to form the PTC laminates for CE6 and CE7 are shown in Table 2. The average resistances of the test samples of Comparative Examples 6 and 7 were determined and shown in Table 2.

TABLE 2

| | Number of PTC polymer material layers | Second PTC polymer material layer | First PTC polymer material layer | Third PTC polymer material layer | Resistance (ohm) |
|---|---|---|---|---|---|
| E1 | 2 | Formula(7) | Formula(1) | — | 0.0453 |
| E2 | 2 | Formula(7) | Formula(2) | — | 0.0472 |
| E3 | 2 | Formula(7) | Formula(3) | — | 0.0489 |
| E4 | 2 | Formula(7) | Formula(4) | — | 0.0501 |
| E5 | 2 | Formula(7) | Formula(5) | — | 0.0523 |
| E6 | 2 | Formula(7) | Formula(6) | — | 0.0543 |
| E7 | 3 | Formula(2) | Formula(7) | Formula(2) | 0.0497 |
| E8 | 3 | Formula(7) | Formula(2) | Formula(7) | 0.0452 |
| E9 | 2 | Formula(8) | Formula(2) | — | 0.0444 |
| E10 | 2 | Formula(8) | Formula(5) | — | 0.0446 |
| CE1 | 1 | Formula(7) | — | — | 0.0553 |
| CE2 | 1 | Formula(8) | — | — | 0.0491 |
| CE3 | 1 | Formula(2) | — | — | 0.0496 |
| CE4 | 1 | Formula(5) | — | — | 0.0498 |
| CE5 | 2 | Formula(7) | Formula(8) | — | — |
| CE6 | 2 | Formula(2) | Formula(1) | — | 0.0488 |
| CE7 | 2 | Formula(2) | Formula(3) | — | 0.0512 |

"—" means not added or does not exist.

Performance Tests

Resistances at Different Temperatures

Ten test samples for each of E1-E10 and CE1-CE5 were subjected to a test to determine the resistances of the test samples of each of E1-E10 and CE1-CE5 at temperatures between 25 to 185° C.

Figure 4:
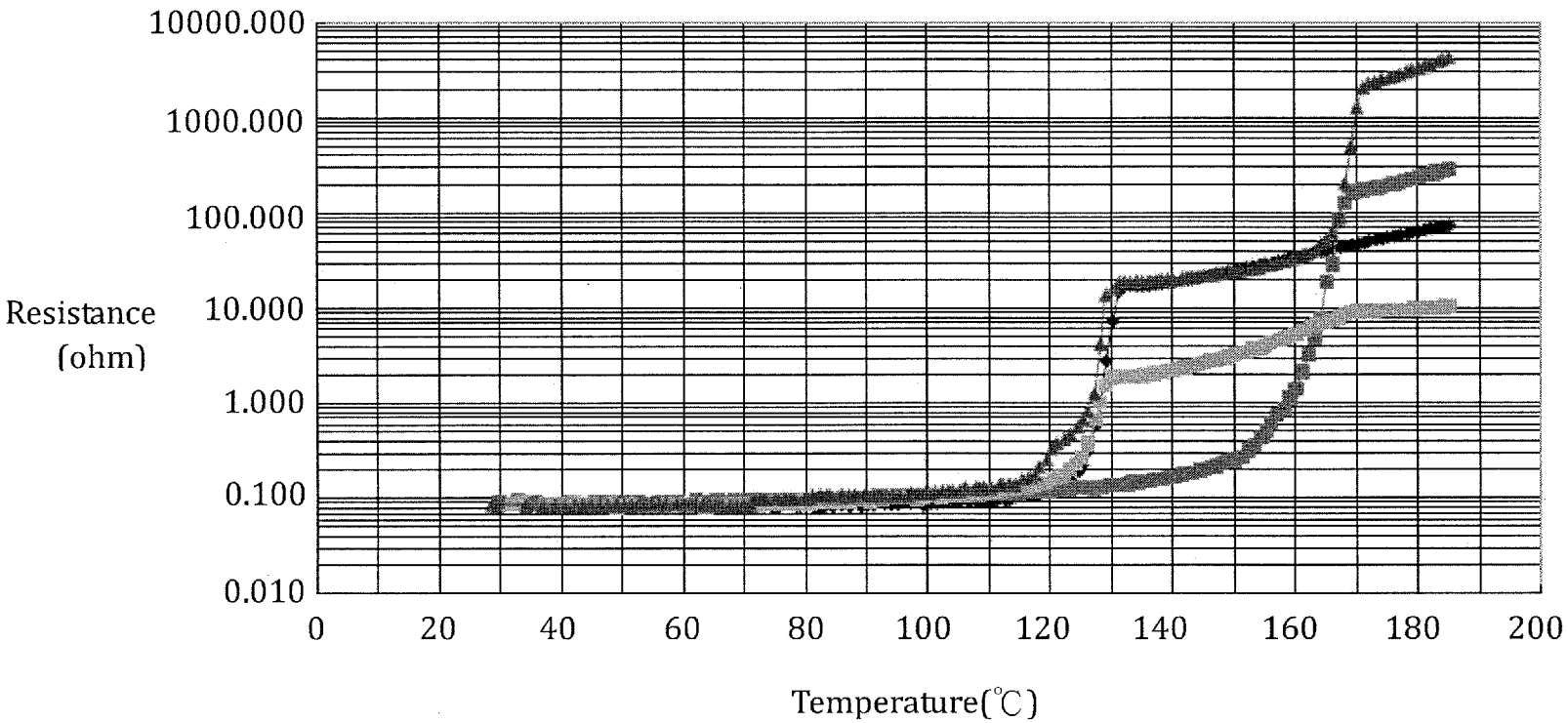
FIG. 4 is a plot showing the relationship between temperature and resistance for the test samples of Example 2 and Comparative Examples 1-3.

The resistance test for each test sample was conducted by increasing stepwise the temperature applied to each test sample from an initial temperature of 25° C. to a final temperature of 185° C. under a fixed rate of 2° C./min. The resistance of each of the test samples of E1-E10 and CE1-CE5 under every temperature was recorded. The results of the resistance test are shown in Table 3, and the relationship between the temperature and the resistance for the test samples of E2 and CE1 to CE3 are shown in FIG. 4. The higher the resistance of the PTC laminate under the same temperature, the higher the working voltage of the PTC laminate will be. The results show that Examples 1-10 can be operated under a higher working voltage than that of Comparative Examples 1-7. For instance, E2 has a resistance of 24.58 ohm under 140° C. and a resistance of 1313.05 ohm under 170° C., which are higher than those of CE1 having a resistance of 18.98 ohm under 140° C. and a resistance of 47.86 ohm under 170° C.

Thermal Derating Test

Test samples for each of E1-E10 and CE1-CE7 were subjected to a thermal derating test to determine a thermal derating rate (operating current at test temperature/operating current at 25×100%) of each of E1-E10 and CE1-CE7. The thermal derating test was conducted by measuring the operating current of each test sample at −40, 25, 85 and 125.

Figure 5:
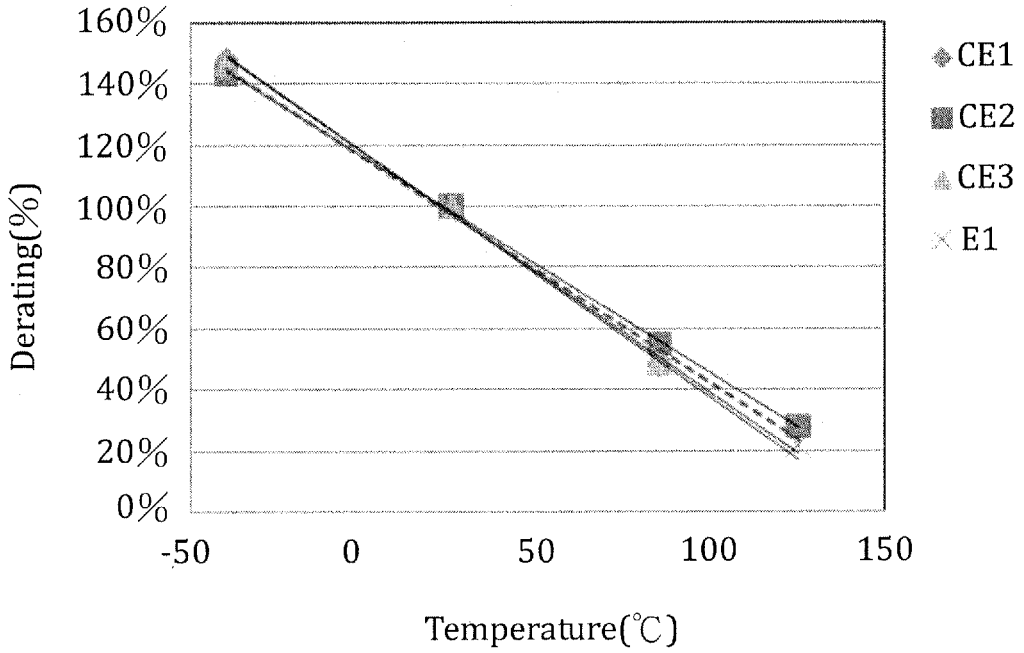
FIG. 5 is a plot showing the relationship between temperature and derating ratio for the test samples of Example 2 and Comparative Examples 1-3.

The results of the thermal derating test are shown in Table 3. The relationship between the temperature and the derating ratio for the test samples of E2 and CE1-CE3 are shown in FIG. 5.

Thermal Runway Test

Five test samples for each of E1-E10 and CE1-CE7 were subjected to a thermal runaway test. The thermal runaway test for each test sample was conducted by increasing stepwise the voltage applied to each test sample from an initial voltage of 20 Vdc to a final voltage of 100 Vdc under a fixed current of 100 A that is sufficient to enable each test sample to burn down. The applied voltage was increased at an increment of 5 Vdc per step and the duration time for each step was 2 minutes (i.e., each newly applied voltage lasted for two minutes). The maximum endurable voltage (i.e., the breakdown voltage) of each of the test samples of E1-E10 and CE1-CE7 was recorded. The results of the thermal runaway test are shown in Table 3.

The thermal derating test results (see Table 3) show that the operating current of the test samples of CE1 at 125° C. was close to zero due to the lack of PVDF in the PCT polymer material layer. The operating currents of the test samples of CE3 and CE4 having only one polymer material layer at 125° C. were also close to zero. Each of the test samples of CE1, CE3 and CE4 can only be operated at an operating temperature ranging from −40 to 85° C.

The operating currents of the test samples of CE6 and CE7 including polyolefin and PVDF in each of the first and second PTC polymer material layers at 125° C. were also close to zero. Each of the test samples of CE6 and CE7 can only be operated at an operating temperature ranging from −40 to 85° C.

The operating currents of the test samples of E1-E10 can still maintain above 20% at 125° C. Each of the test samples of E1-E10 (one of the PCT polymer material layers containing PVDF) can be operated at an operating temperature ranging from −40 to 125° C.

The thermal runway test results (see Table 3) show that the breakdown voltages of E1-E10 (90 to 100V) are much higher than those of CE1-CE4 (30 to 60V), which demonstrates that the over-current protection device of the disclosure can be operate at a higher voltage.

In conclusion, with the inclusion of the first and second PTC polymer material layers, at least one of which contains PVDF and polyolefin in the over-current protection device of the disclosure, the aforesaid drawback associated with the prior art may be alleviated.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. An over-current protection device comprising:

first and second electrodes; and a multilayered structure disposed between said first and second electrodes and including first and second PTC

TABLE 3

| | Resistance (ohm) | | Thermal derating ratio (%) | | | | Thermal runaway test | |
|---|---|---|---|---|---|---|---|---|
| | | | | | | | Trip surface | Breakdown voltage |
| | 140° C. | 170° C. | −40 | 25 | 85 | 125 | temp. ( ) | (V) |
| E1 | 19.81 | 1445.41 | 143 | 100 | 55 | 26 | 138.3 | 90 |
| E2 | 24.58 | 1313.05 | 143 | 100 | 53 | 22 | 129.0 | 100 |
| E3 | 25.14 | 1223.88 | 143 | 100 | 51 | 21 | 128.5 | 100 |
| E4 | 20.06 | 1222.98 | 143 | 100 | 55 | 26 | 139.5 | 90 |
| E5 | 20.74 | 1199.09 | 143 | 100 | 53 | 22 | 129.9 | 100 |
| E6 | 23.67 | 1045.10 | 144 | 100 | 51 | 21 | 129.1 | 100 |
| E7 | 19.95 | 1241.88 | 143 | 100 | 53 | 22 | 140.5 | 95 |
| E8 | 26.47 | 1082.62 | 143 | 100 | 53 | 24 | 140.4 | 90 |
| E9 | 21.89 | 1267.90 | 143 | 100 | 54 | 23 | 135.1 | 100 |
| E10 | 20.10 | 1231.01 | 143 | 100 | 54 | 23 | 135.3 | 95 |
| CE1 | 18.98 | 47.86 | 148 | 100 | 48 | — | 122.8 | 60 |
| CE2 | 0.17 | 171.06 | 143 | 100 | 55 | 28 | 145.1 | 30 |
| CE3 | 2.21 | 9.26 | 147 | 100 | 49 | — | 123.5 | 30 |
| CE4 | 4.56 | 16.07 | 147 | 100 | 49 | — | 123.8 | 30 |
| CE5 | — | — | — | — | — | — | — | — |
| CE6 | 3.43 | 8.66 | 147 | 100 | 49 | — | 122.1 | 30 |
| CE7 | 1.78 | 11.77 | 147 | 100 | 50 | — | 123.8 | 30 |

"—" means not exist or did not tested.

polymer material layers that are stacked one above the other and that are bonded to each other;

wherein said first PTC polymer material layer includes a first polymer matrix and a particulate conductive filler dispersed in said first polymer matrix, said first polymer matrix being made from a first polymer composition; and wherein said second PTC polymer material layer includes a second polymer matrix and a particulate conductive filler dispersed in said second polymer matrix, said second polymer matrix being made from a second polymer composition;

wherein one of said first and second polymer compositions contains polyvinylidene fluoride and polyolefin and the other of said first and second polymer compositions contains polyolefin or polyvinylidene fluoride;

wherein the other of said first and second polymer compositions is substantially free of polyvinylidene fluoride when containing polyolefin; and wherein the other of said first and second polymer compositions is substantially free of polyolefin when containing polyvinylidene fluoride.

2. The over-current protection device of claim 1, wherein each of said first and second polymer compositions further contains a grafted polyolefin.

3. The over-current protection device of claim 1, wherein said one of said first and second polymer compositions has a weight ratio of said polyvinylidene fluoride to said polyolefin that ranges from 1:9 to 9:1.

4. The over-current protection device of claim 1, wherein said polyvinylidene fluoride has a melt flow rate ranging from 0.5 g/10 min to 30 g/10 min measured according to ASTM D-1238 under a temperature of 230° C. and a load of 12.5 Kg.

5. The over-current protection device of claim 1, wherein said polyvinylidene fluoride has a melting point ranging from 140 to 180° C.

6. The over-current protection device of claim 1, wherein said particulate conductive fillers of said first and second polymer compositions are carbon black.

7. The over-current protection device of claim 1, wherein said polyolefin of each of said first and second polymer compositions is polyethylene.

8. The over-current protection device of claim 1, wherein said first PTC polymer material layer contains 4.7-42.3 wt % of polyvinylidene fluoride, 4.7-42.3 wt % of polyolefin based on 100 wt % of said first PTC polymer material layer.

9. The over-current protection device of claim 1, wherein said second PTC polymer material layer contains 23.5-45.0 wt % of the polyolefin based on 100 wt % of said second PTC polymer material layer.

10. The over-current protection device of claim 1, wherein said multilayered structure further includes a third PTC polymer material layer that is stacked on said first PTC polymer material layer, said third PTC polymer material layer including a third polymer matrix and a particulate conductive filler dispersed in said third polymer matrix, said third polymer matrix being made from a third polymer composition, said first polymer composition containing polyvinylidene fluoride and polyolefin, said third polymer composition containing polyolefin or polyvinylidene fluoride.

11. The over-current protection device of claim 1, wherein said multilayered structure further includes a third PTC polymer material layer that is stacked on said first PTC polymer material layer, said third PTC polymer material layer including a third polymer matrix and a particulate conductive filler dispersed in said third polymer matrix, said third polymer matrix being made from a third polymer composition, said first polymer composition containing polyvinylidene fluoride or polyolefin, said third polymer composition containing polyolefin and polyvinylidene fluoride.

12. An over-current protection device comprising:

first and second electrodes; and a multilayered structure disposed between said first and second electrodes and including first and second PTC polymer material layers that are stacked one above the other and that are bonded to each other;

wherein said first PTC polymer material layer includes a first polymer matrix and a particulate conductive filler dispersed in said first polymer matrix, said first polymer matrix being made from a first polymer composition that contains polyvinylidene fluoride and polyolefin, the weight ratio of said polyvinylidene fluoride to said polyolefin ranging from 1:9 to 9:1;

wherein said second PTC polymer material layer includes a second polymer matrix and a particulate conductive filler dispersed in said second polymer matrix, said second polymer matrix being made from a second polymer composition that contains at least one of polyolefin and polyvinylidene fluoride;

wherein when said second polymer composition contains polyolefin and polyvinylidene fluoride, the weight ratio of said polyvinylidene fluoride to said polyolefin of said second polymer composition is out of the range of from 1:9 to 9:1; and wherein said over-current protection device exhibits a trip surface temperature ranging from 110 to 150° C. and a breakdown voltage ranging from 30 to 100 V.

* * * * *